US008038474B2

(12) United States Patent
Ju

(10) Patent No.: US 8,038,474 B2
(45) Date of Patent: Oct. 18, 2011

(54) ASSEMBLED ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 280 days.

(21) Appl. No.: 12/167,455

(22) Filed: Jul. 3, 2008

(65) Prior Publication Data

US 2011/0130036 A9 Jun. 2, 2011

(30) Foreign Application Priority Data

Sep. 27, 2007 (CN) ..... 2007 2 0057544 U

(51) Int. Cl.
*H01R 13/648* (2006.01)

(52) U.S. Cl. ..... 439/607.01

(58) Field of Classification Search ..... 439/607.01, 439/79, 701, 724, 626, 607.38, 607.4, 607.25
See application file for complete search history.

(56) References Cited

U.S. PATENT DOCUMENTS

| | | | | |
|---|---|---|---|---|
| 6,095,861 | A * | 8/2000 | Lin et al. | 439/607.25 |
| 6,203,335 | B1 * | 3/2001 | Chang | 439/79 |
| 6,346,009 | B1 * | 2/2002 | Lin | 439/607.01 |
| 6,758,685 | B1 * | 7/2004 | Huang et al. | 439/79 |
| 7,402,078 | B2 * | 7/2008 | Wan et al. | 439/607.01 |
| 2004/0014336 | A1 * | 1/2004 | Merz | 439/76.1 |

* cited by examiner

*Primary Examiner* — Edwin A. Leon
(74) *Attorney, Agent, or Firm* — Rosenberg, Klein & Lee

(57) ABSTRACT

An assembled electrical connector includes an insulating housing and at least two sets of electrical conducting terminals. The insulating housing has a main body, a first tongue and a second tongue extending from the main body and perpendicular to the main body. The first tongue is longer than the second tongue, and the second tongue is located at a side of the first tongue in a lengthwise direction. The at least two sets of electrical conducting terminals include a first terminal set and a second terminal set. The first terminal set is arranged at a side of the first tongue, and the second terminal set is arranged at a side of the second tongue. Compared with prior art, such a structure can miniaturize the volume of the electrical connector apparently and further miniaturize the volume of an electronic product utilizing the electrical connector.

16 Claims, 16 Drawing Sheets

ASSEMBLED ELECTRICAL CONNECTOR

BACKGROUND OF THE INVENTION

1. Field of the Invention

The invention relates to an assembled electrical connector.

2. Description of the Prior Art

With the development of digital market, many kinds of electronic products are becoming a part of human lives gradually and are being applied to many fields quickly. However, due to the developmental tendency of technique, these electronic products tend to be continuously miniaturized from largeness to smallness, from heaviness to lightness and from stationary to portability, for fulfilling people's needs for portable electronic products; moreover, people's expectations for the functions and efficiency of electronic products are continuously increased as well. In this regards, each electronic company endeavors to develop electronic products with small volume, multiple function and better efficiency for increasing market share.

As each kind of electronic products with small volume is produced, electrical components utilized in the electronic products are getting to be integrated and lightened for meeting the developmental tendency of electronic products. Thus, with the development of scientific technique, the efficiency of electronic products has been increasing apparently.

Because of development of digital technique, the functions of electronic products are promoted; for example, since digital televisions are continuously developed to be with high resolution, high contrast and high frame rate, the efficiency of electronic products is enhanced. Besides, with the electronic products are miniaturized, the efficiency of small electrical component and transmission rate are enhanced as well. In other words, since transmission rate, efficiency in high frequency, synchronous transfer between audio frequency and video frequency are required to be enhanced in the electrical connector of electronic products, the electrical connector of the electrical connector is developed to be equipped with more applications. For example, the transmitting components generally applied to computers in industries, such as universal serial bus (USB), exterior serial advanced technology attachment (E-SATA) and the institute of electrical and electronics engineers 1394 B type (IEEE 1394B), have also been applied to many different fields.

For a computer which can simultaneously use peripheral equipments complied with the three transmitting interfaces respectively, i.e., USB, E-SATA and IEEE 1394B, it is required a transmitting equipment complied with the three transmitting interfaces. As shown in FIG. 1. FIG. 1 is a schematic diagram illustrating an assembled electrical connector 9 generally applied to industry. The assembled electrical connector comprises an IEEE 1394B transmitting interface 90 and two USB transmitting interface 91. The IEEE 1394B transmitting interface 90 is located above the two USB transmitting interfaces 91, and the three transmitting interfaces are stacked together to be an assembled electrical connector.

In the trend of miniaturization and thin thickness, no matter if the three electrical connectors are assembled independently or integrated with a circuit board, the space inside the board will be wasted and the thickness of the product will be increased. As a result, the computers will become unfavorable to be miniaturized and lightened.

Accordingly, the main scope of the invention is to provide an assembled electrical connector, so as to solve the aforesaid problems.

SUMMARY OF THE INVENTION

An object of the present invention is to provide an assembled electrical connector with miniaturized volume.

In order to achieve aforesaid object, an assembled electrical connector presented comprises an insulating housing and at least two sets of electrical conducting terminals. The insulating housing has a main body, a first tongue and a second tongue which are extended from the main body and perpendicular to the main body, wherein the first tongue is longer than the second tongue, and the second tongue is located at a side of the first tongue in a lengthwise direction. The at least two sets of electrical conducting terminals comprises a first terminal set and a second terminal set, wherein the first terminal set is arranged at a side of the first tongue, and the second terminal set is arranged at a side of the second tongue.

Compared with prior art, the assembled electrical connector of the invention has a first tongue and a second tongue extended from the main body and perpendicular to the main body, wherein the first tongue is longer than the second tongue, and the second tongue is located at a side of the first tongue in a lengthwise direction. Such a structure can miniaturize total volume of the electrical connector apparently and further miniaturize total volume of an electronic product utilizing the electrical connector.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
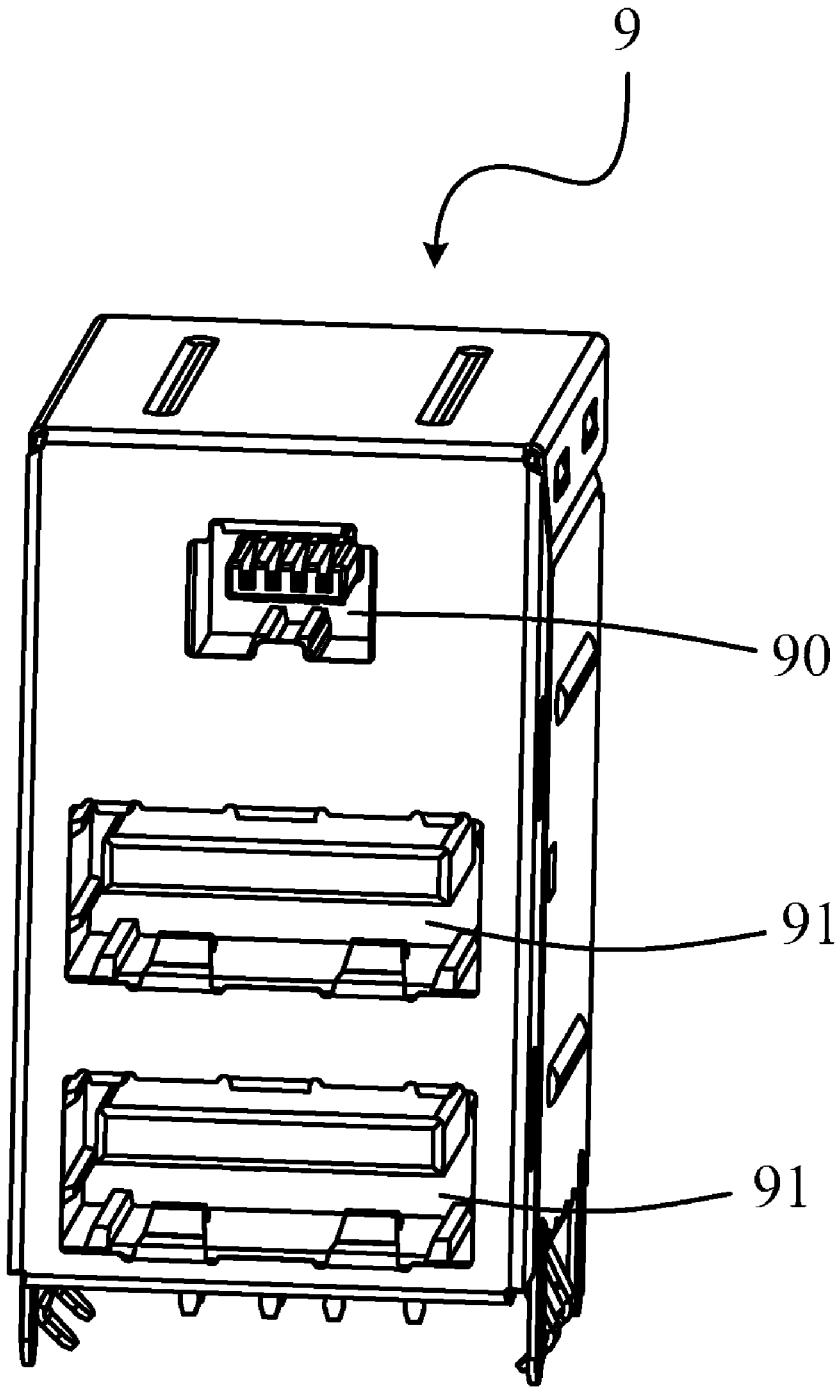
FIG. 1 (PRIOR ART)
FIG. 1 is a perspective diagram illustrating an assembled electrical connector in prior art.
Figure 2:
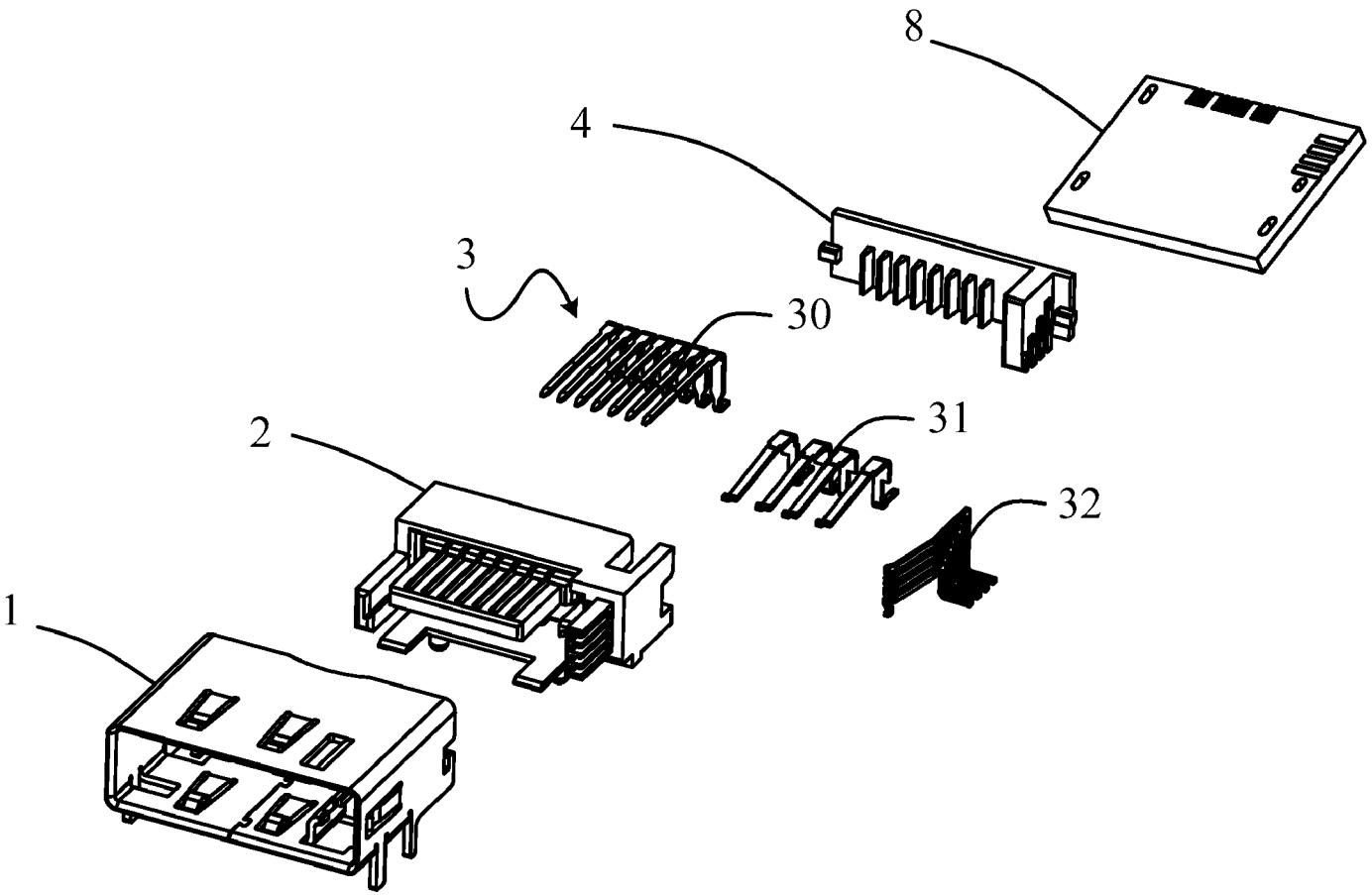
FIG. 2 is an exploded view diagram illustrating an assembled electrical connector of the invention.

Please refer to FIG. 2. An assembled electrical connector comprises a shield 1, an insulating housing 2, electrical conducting terminals 3 and a terminal positioning plate 4, wherein the insulating housing 2 is accommodated in the shield 1. The shield 1, the insulating housing 2, the electrical conducting terminals 3 and the terminal positioning plate 4 are assembled together and then assembled with the circuit board 8.

Figure 3:
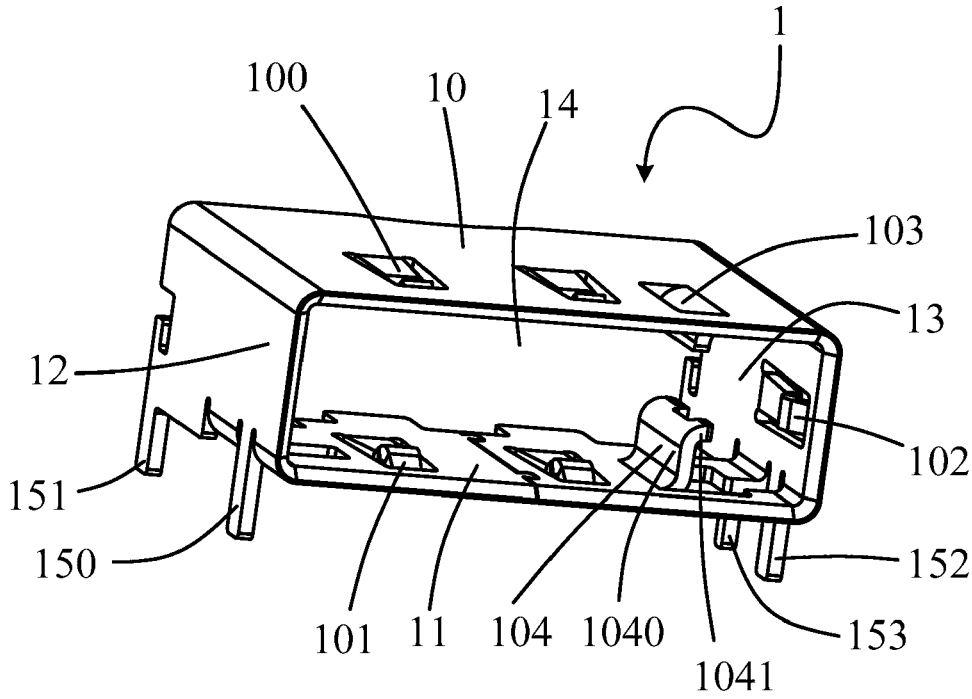
FIG. 3 is a perspective diagram illustrating a shield of the assembled electrical connector shown in FIG. 2.
Figure 4:
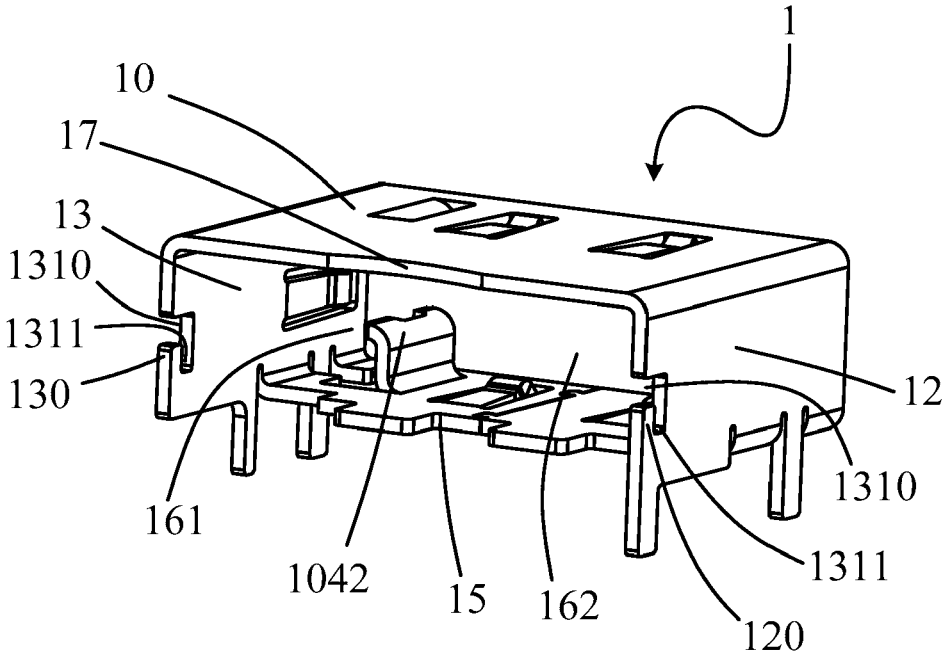
FIG. 4 is a perspective diagram illustrating a shield of the assembled electrical connector shown in FIG. 2 in another view.

Please refer to FIG. 3 and FIG. 4. The shield 1 comprises an upper 10, a lower 11, a left 12 and a right 13 side walls to form a first accommodating space 14 for accommodating the insulating housing 2. Two resilient tabs 100 are disposed on the upper side wall 10, and the two resilient tabs 100 extend inward the first accommodating space 14. Two resilient tabs 101 are disposed on the lower side wall 11, and the two resilient tabs 101 extend inward the first accommodating space 14 too. A resilient tab 102 is disposed on the right side wall 13, and the resilient tab 102 extends inward the first accommodating space 14. A first stop portion 104 is disposed on the lower side wall 11 of the shield 1, and a second stop portion 103 is disposed on the upper side wall 10. The second stop portion 103 is disposed in opposition to the first stop portion 104 and extends inward the first accommodating space 14. The second stop portion 103 appears in arc shape, and the first stop portion 104 appears in S-curved shape and comprises a base portion 1040. A head portion 1041 is extended from the base portion 1040 and a convex arc surface 1042 is formed on the head portion 1041. The first stop portion 104 forms a second accommodating space 161 together with the upper side wall 10, the lower side wall 11 and the right side wall 13 of the shield 1. The first stop portion 104 forms a third accommodating space 162 together with the upper side wall 10, the lower side wall 11 and the left side wall 12 of the shield 1.

Four jointing feet 150, 151, 152 and 153 are formed on a bottom 15 of shield 1 for fixing the assembled electrical connector on the circuit board 8. Two identical grooves 120 and 130 are respectively formed on the left side wall 12 and the right side wall 13 on a rear end 17 of the shield 1 for fixing the terminal positioning plate 4. Each of the grooves 120 and 130 comprises a first part 1310 extending forward from the rear end 17 and a second part 1311 extending downward from the first part 1310.

Figure 5:
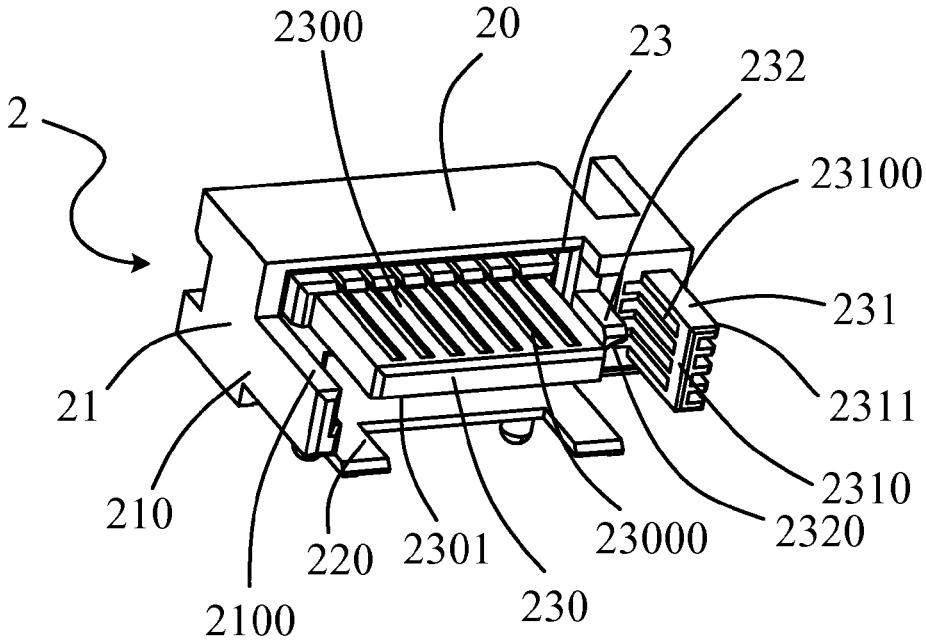
FIG. 5 is a perspective diagram illustrating an insulating housing of the assembled electrical connector shown in FIG. 2.
Figure 6:
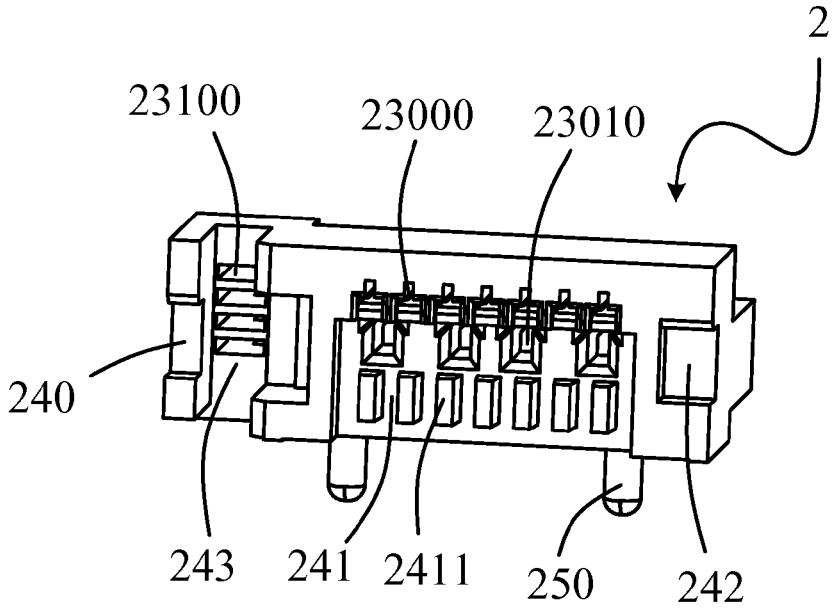
FIG. 6 is a perspective diagram illustrating an insulating housing of the assembled electrical connector shown in FIG. 2 in a rear view.
Figure 7:
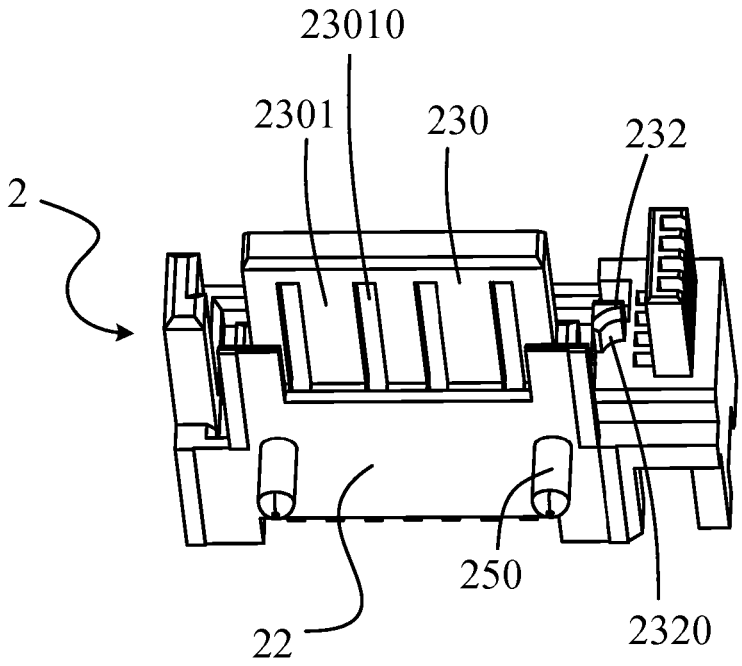
FIG. 7 is a perspective diagram illustrating an insulating housing of the assembled electrical connector shown in FIG. 2 in another view

Please refer to FIG. 5 to FIG. 7. The insulating housing 2 comprises a main body 20, wherein a side plate 210 is formed on a left side 21 of the main body 20; a bottom plate 220 is formed on a bottom 22 of the main body 20; and a first tongue 230 and a second tongue 231 are formed on a front end 23 of the main body 20. A stop block 232 is disposed between the first tongue 230 and the second tongue 231, and a concave arc surface 2320 is formed on a bottom of the stop block 232. The first tongue 230 has a top surface 2300 and a bottom surface 2301. A first terminal accommodating groove 23000 is formed on the top surface 2300, and a third terminal accommodating groove 23010 is formed on the bottom surface 2301. Both the first and third terminal accommodating grooves 23000 and 23010 are led to the rear end 24 of the insulating housing 2. The second tongue 231 has a left side surface 2310 and a right side surface 2311. A second terminal accommodating groove 23100 is formed on the left side surface 2310 and led to the rear end 24 of the insulating housing 2. The second terminal accommodating groove 23100 penetrates to the right side surface 2311 from the left side surface 2310. The first tongue 230 and the second tongue 231 are perpendicular to each other at the front end 23 of the main body 20, and the first tongue is formed in horizontal. The second tongue 231 is formed in vertical at the right side of the first tongue 230, and the first tongue 230 is longer than the second tongue 231.

The rear end 24 of the insulating housing 2 has a first groove 240, second grooves 241, a third groove 242 and a fourth groove 243 for respectively fastening the terminal positioning plate 4, and the second grooves 241 are formed between two side blocks 2411. Two positioning columns 250 are formed on a bottom 25 of the insulating housing 2, which are fixed on the circuit board 8 respectively.

Except for this manner that the first tongue 230 is formed in horizontal and the second tongue 231 is formed in vertical, the first tongue 230 can be formed in vertical and the second tongue 231 can be form in horizontal below the first tongue 230. Namely, the volume of the assembled electrical connector can be miniaturized by this manner. Besides, it also can form second tongues 231 in vertical respectively at both sides of the first tongue 230 formed in horizontal. Accordingly, the total volume of the assembled electrical connector also can be miniaturized in this manner.

Figure 8:
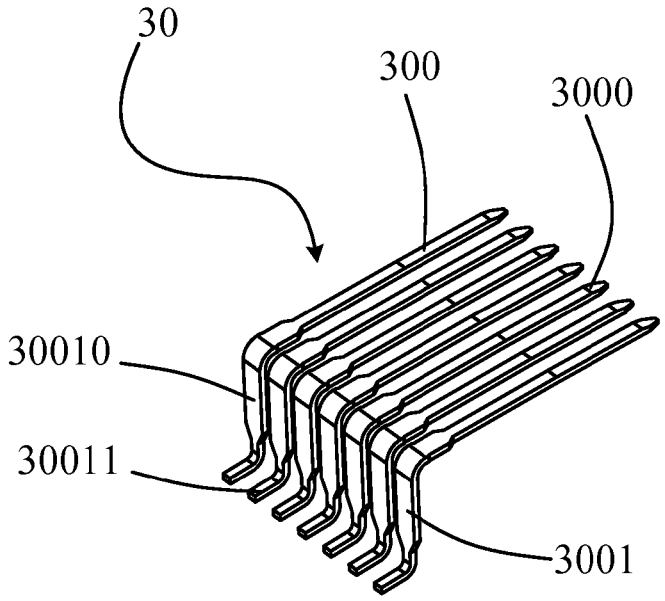
FIG. 8 is a perspective diagram illustrating an electrical conducting terminal set complied with E-SATA standard of the assembled electrical connector shown in FIG. 2.
Figure 9:
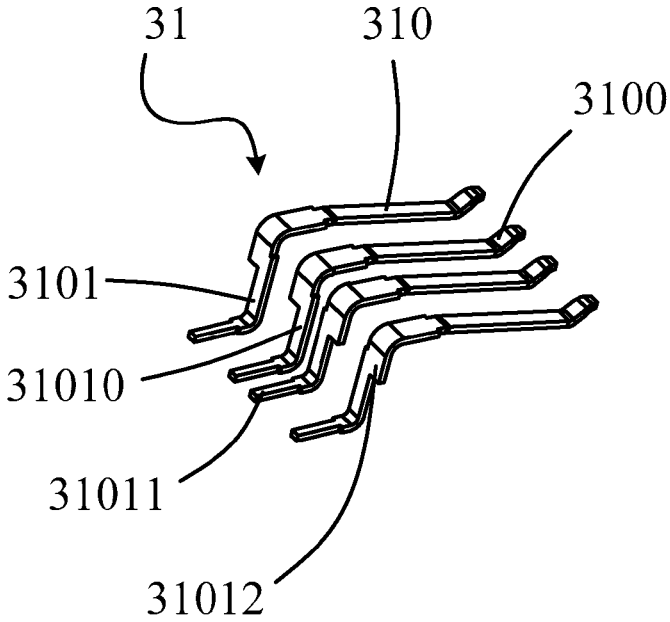
FIG. 9 is a perspective diagram illustrating an electrical conducting terminal set complied with USB standard of the assembled electrical connector shown in FIG. 2.
Figure 10:
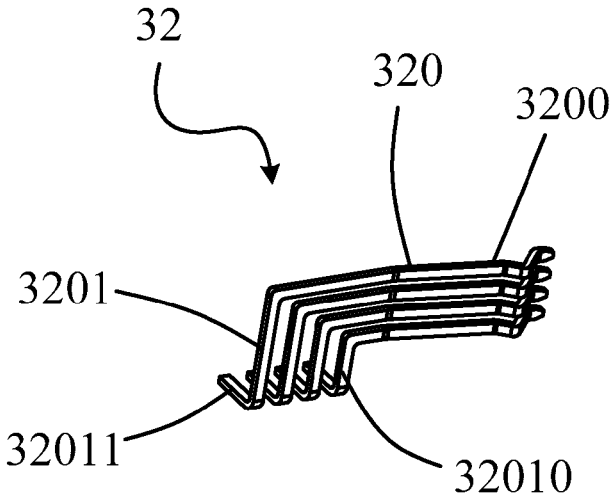
FIG. 10 is a perspective diagram illustrating an electrical conducting terminal set complied with IEEE 1394B standard of the assembled electrical connector shown in FIG. 2.

Please refer to FIG. 8 to FIG. 10. The electrical conducting terminals 3 comprises a first terminal set 30, a second terminal set 32 and a third terminal set 31 (as shown in FIG. 2). The first terminal set 30 is complied with E-SATA standard; the second terminal set 32 is complied with IEEE 1394B standard; and, the third terminal set 31 is complied with USB standard.

Each terminal 300 of the first terminal set 30 comprises a head portion 3000 and a terminal foot 3001 extended from the head portion 3000. The terminal foot 3001 comprises a fixing portion 30010 and a welding portion 30011 extended from the fixing portion 30010, and the welding portion 30011 is welded on the circuit board 8 as shown in FIG. 2.

Each terminal 320 of the second terminal set 32 comprises a head portion 3200 and a terminal foot 3201 extended from the head portion 3200. The terminal foot 3201 comprises a fixing portion 32010 and a welding portion 32011 extended from the fixing portion 32010, and the welding portion 32011 is welded on the circuit board 8 as shown in FIG. 2.

Each terminal 310 of the third terminal set 31 comprises a head portion 3100 and a terminal foot 3101 extended from the head portion 3 100. The terminal foot 3101 comprises a fixing portion 31010 and a welding portion 31011 extended from the fixing portion 31010, and the welding portion 31011 is welded on the circuit board 8 as shown in FIG. 2. The fixing portion 31010 has an engaging portion 31012.

Figure 11:
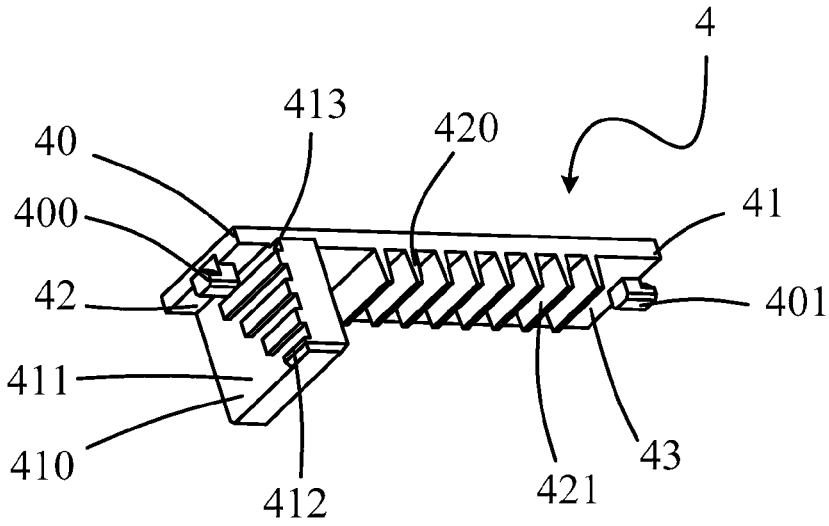
FIG. 11 is a perspective diagram illustrating a terminal positioning plate of the assembled electrical connector shown in FIG. 2.

Please refer to FIG. 11. The terminal positioning plate 4 comprises a long base 43 and a protruding block 411 vertically formed on the base 43. The protruding block 411 is located on a front surface 42 of the base 43 and close to a left side 40 of the terminal positioning plate 4. The left side 40 and a right side 41 of the terminal positioning plate 4 respectively has a first positioning column 400 and a second positioning column 401. Long ribs 412 are formed on an external surface 410 of the protruding block 411, and second grooves 413 are formed between two long ribs 412. Protruding ribs 420 are formed on the front surface 42 of the terminal positioning plate 4 and close to the right side of the protruding block 411. And, first grooves 421 are formed between two protruding ribs 420.

Figure 12:
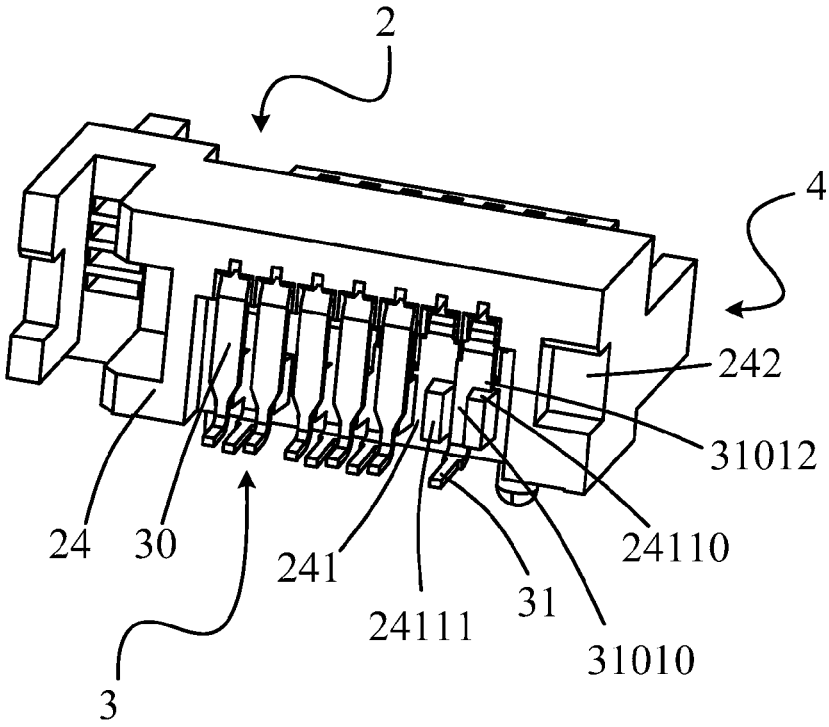
FIG. 12 is a perspective diagram illustrating an insulating housing assembled with electrical conducting terminal sets respectively complied with E-SATA standard and USB standard of the assembled electrical connector shown in FIG. 2.
Figure 13:
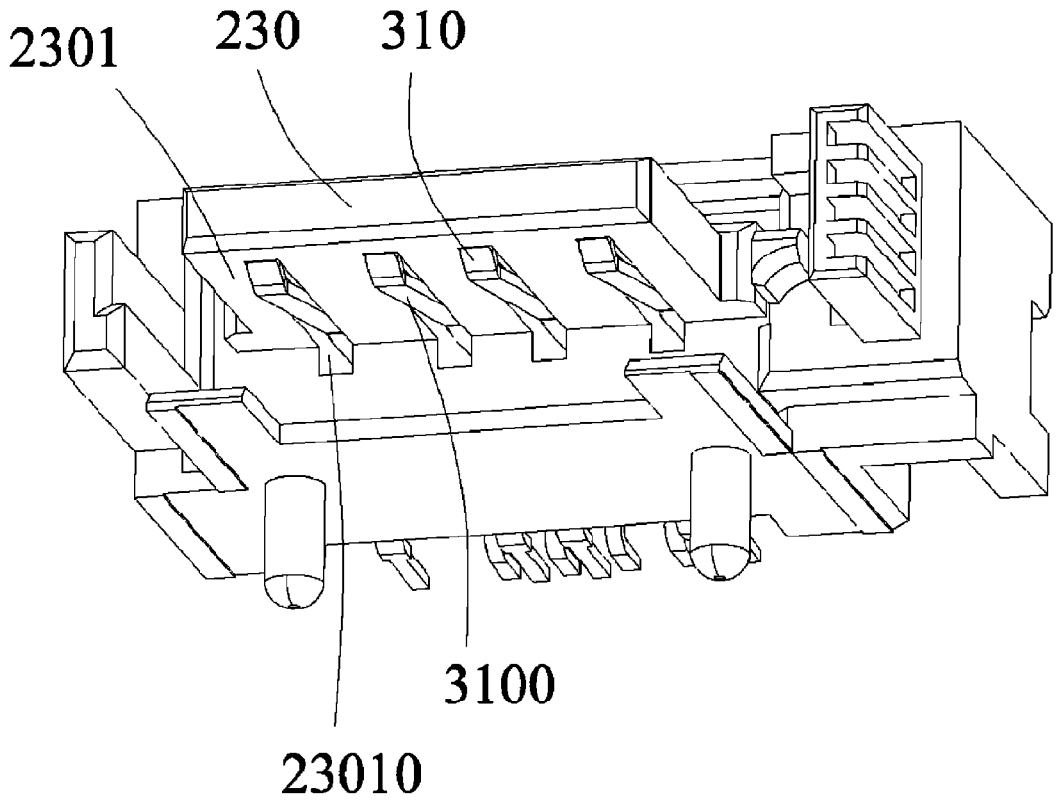
FIG. 13 is a perspective diagram illustrating an insulating housing assembled with electrical conducting terminal sets respectively complied with E-SATA standard and USB standard of the assembled electrical connector shown in FIG. 2 in another view.
Figure 14:
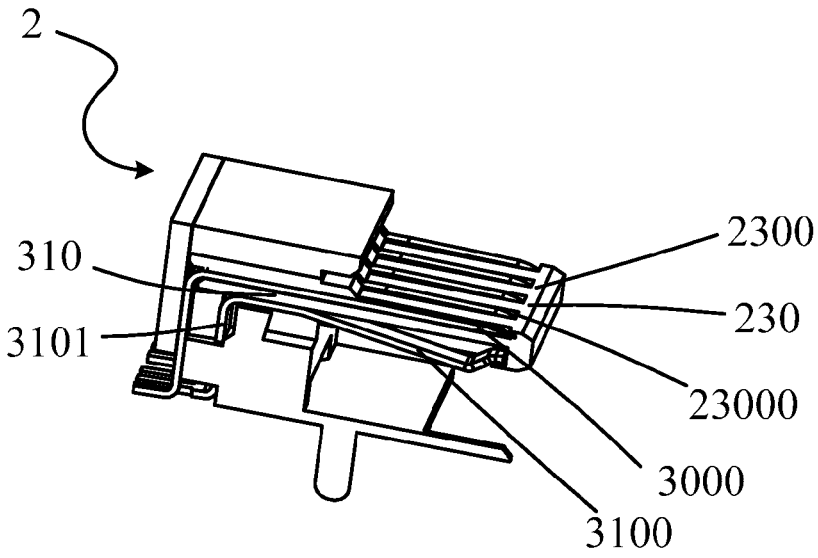
FIG. 14 is a perspectively cross-sectional diagram illustrating an insulating housing assembled with electrical conducting terminal sets respectively complied with E-SATA standard and USB standard of the assembled electrical connector shown in FIG. 2.
Figure 15:
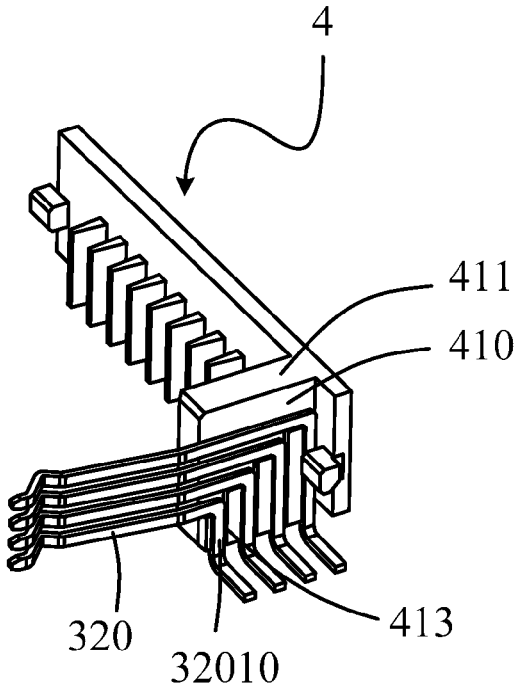
FIG. 15 is a perspective diagram illustrating an electrical conducting terminal complied with IEEE 1394B standard cooperated with a terminal positioning plate of the assembled electrical connector shown in FIG. 2.
Figure 16:
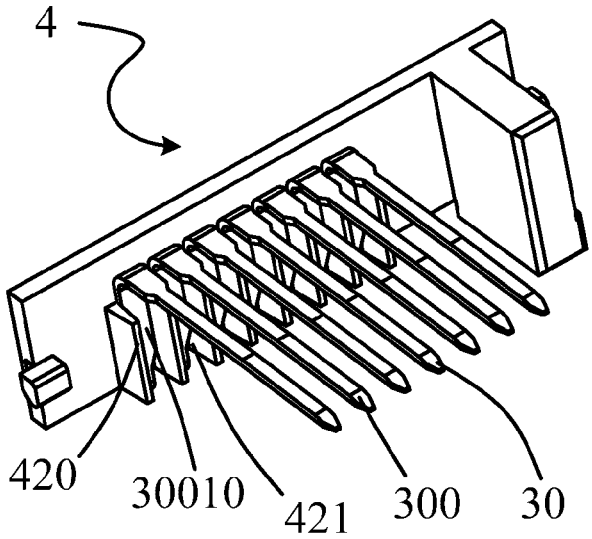
FIG. 16 is a perspective diagram illustrating an electrical conducting terminal complied with E-SATA standard cooperated with a terminal positioning plate of the assembled electrical connector shown in FIG. 2.
Figure 17:
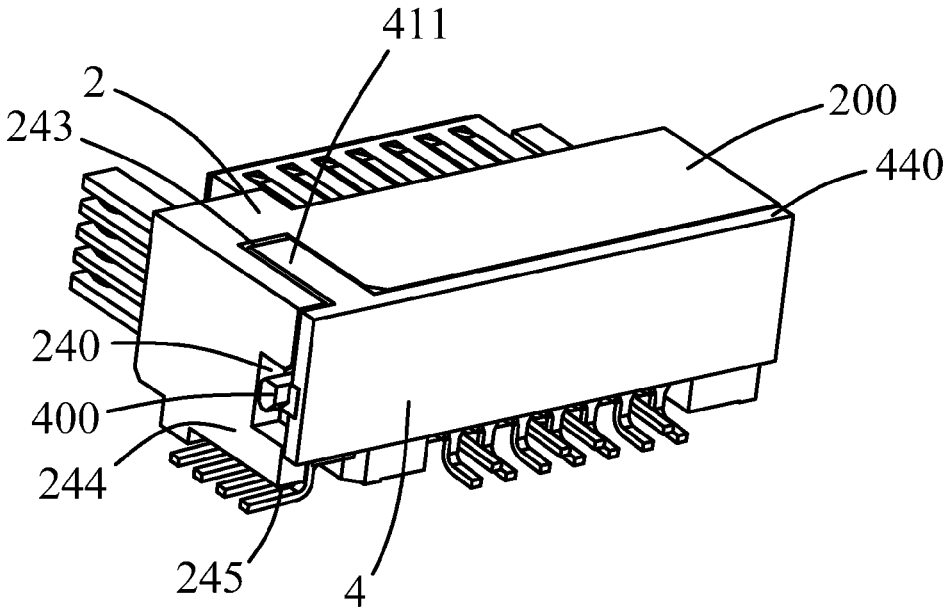
FIG. 17 is a perspective diagram illustrating an insulating housing assembled with electrical conducting terminal sets and a terminal positioning plate of the assembled electrical connector shown in FIG. 2.
Figure 18:
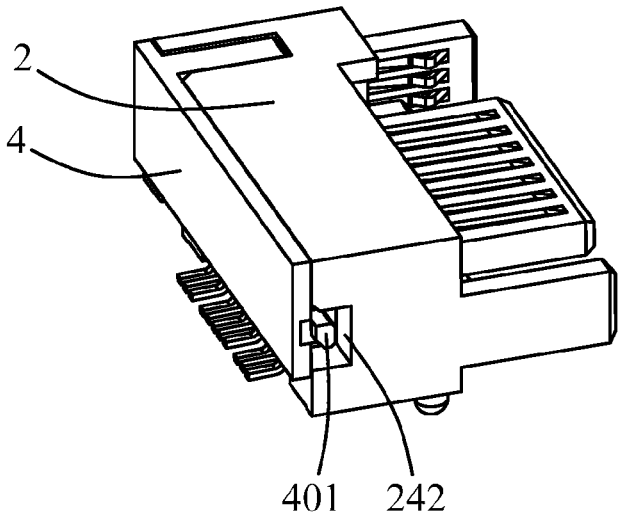
FIG. 18 is a perspective diagram illustrating an insulating housing assembled with electrical conducting terminal sets and a terminal positioning plate of the assembled electrical connector shown in FIG. 2 in another view.
Figure 19:
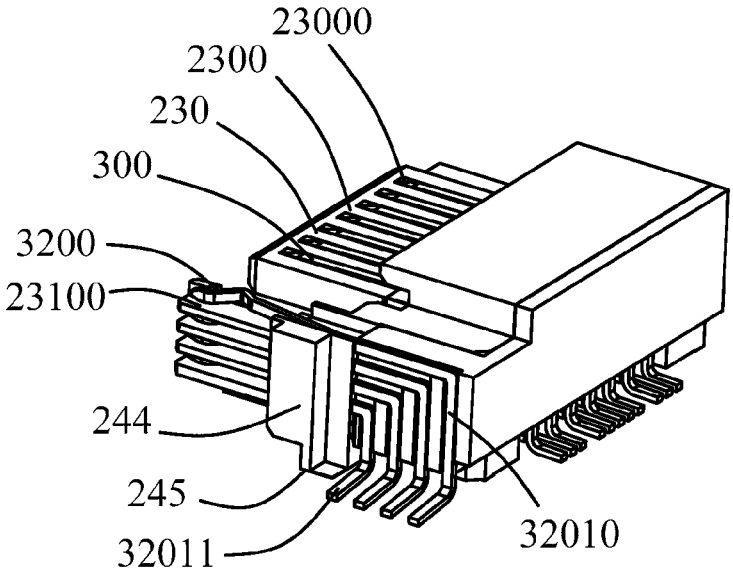
FIG. 19 is a perspectively cross-sectional diagram illustrating an insulating housing assembled with electrical conducting terminal sets and a terminal positioning plate of the assembled electrical connector shown in FIG. 2.

Please refer to FIG. 12 to FIG. 14. During assembly, first of all, the first terminal set 30 shown in FIG. 8 and the third terminal set 31 shown in FIG. 9 are respectively inserted into the first terminal accommodating groove 23000 and the third terminal accommodating groove 23010 formed on the insulating housing 2 shown in FIG. 6. The first terminal set 30 and the third terminal set 31 are inserted into the rear end 24 of the insulating housing 2. The head portion 3000 on each terminal 300 of the first terminal set 30 is located at the first terminal accommodating groove 23000 formed on a top surface 2300 on the first tongue 230 of the insulating housing 2. The head portion 3100 on each terminal 310 of the third terminal set 31 is located at the third terminal accommodating groove 23010 formed on the bottom surface 2301 on the first tongue 230 of the insulating housing 2. The fixing portion 31010 is located at the second groove 241 on the rear end 24 of the insulating housing 2. The engaging portion 31012 formed on the fixing portion 31010 is engaged with a top surface 24110 of the protruding block 2411 formed on the rear end 24 of the insulating housing 2. Each terminal 300 of the first terminal set 30 is disposed on a front surface 24111 of the protruding block 2411 formed on the rear end 24 of the insulating housing 2.

Please refer to FIG. 15 to FIG. 19. Afterward, the second terminal set 32 is disposed into the external surface 410 of the protruding block 411 formed on the terminal positioning plate 4 and the groove 413 corresponding to the fixing portion 32010 of the second terminal set 32. An end of the second terminal set 32 is clipped on another end of the terminal positioning plate 4, and then the terminal positioning plate 4 is inserted into the rear end 24 of the insulating housing 2 to match a top surface 440 of the terminal positioning plate 4 along a top surface 200 of the insulating housing 2. Consequently, the head portion 3200 of each terminal 320 is located in the second terminal accommodating groove 23100 formed on the second tongue 231 of the insulating housing 2. The welding portion 32011 is detoured round a bottom 245 of a side wall 244 of the first groove 240 formed on the rear end 24 of the insulating housing 2. The protruding block 411 is located in the fourth groove 243 formed on the rear end 24 of the insulating housing 2. The first groove 421 is used for accommodating a fixing portion 30010 of each terminal 300 of the first terminal set 30. The first positioning column 400 is located in the first groove 240 formed on the rear end 24 of the insulating housing 2, and the second positioning column 401 is located in the second groove 242 formed on the rear end 24 of the insulating housing 2.

Figure 20:
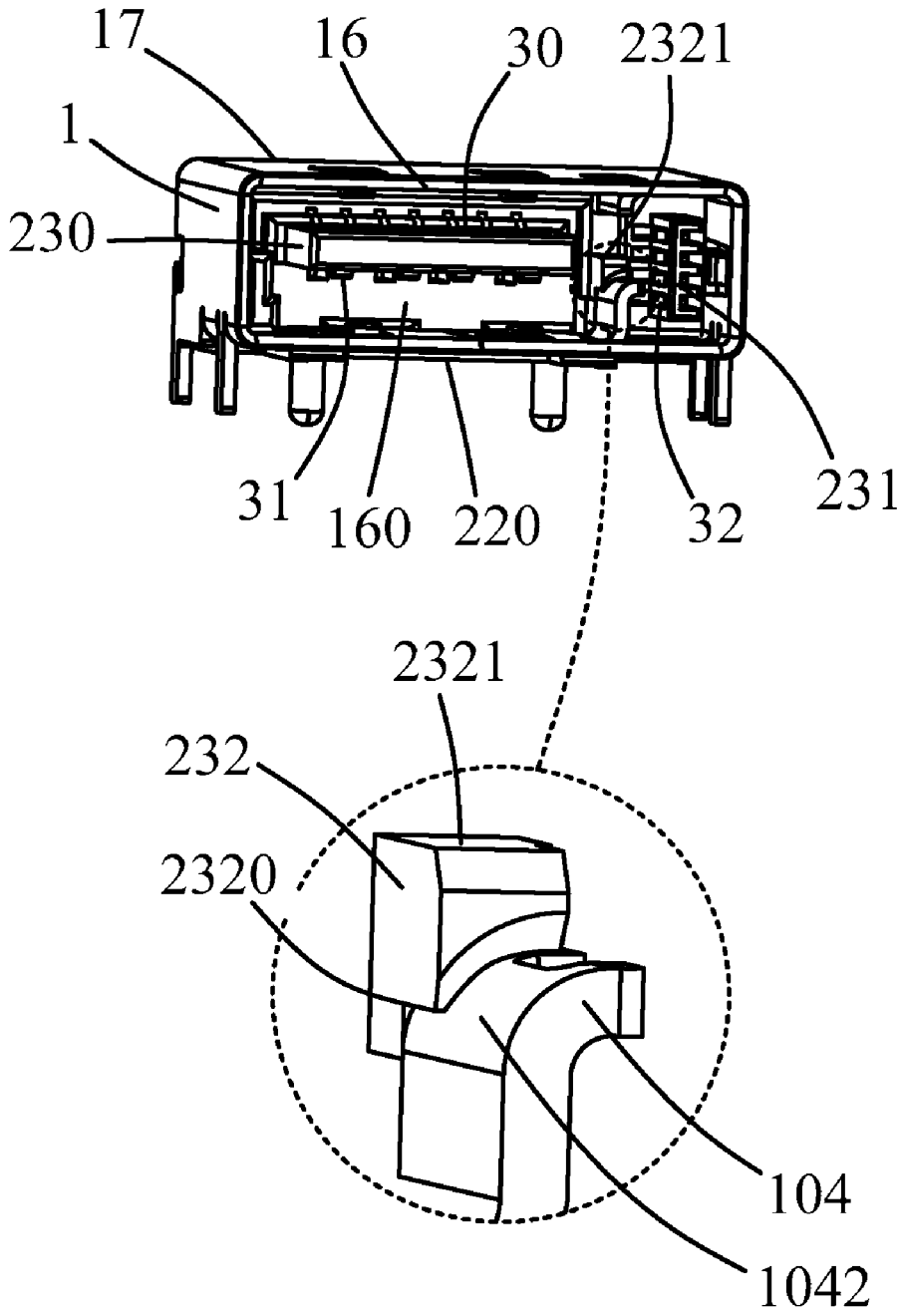
FIG. 20 is a perspective combination diagram illustrating an assembled electrical connector shown in FIG. 2 without associating with a circuit board.
Figure 21:
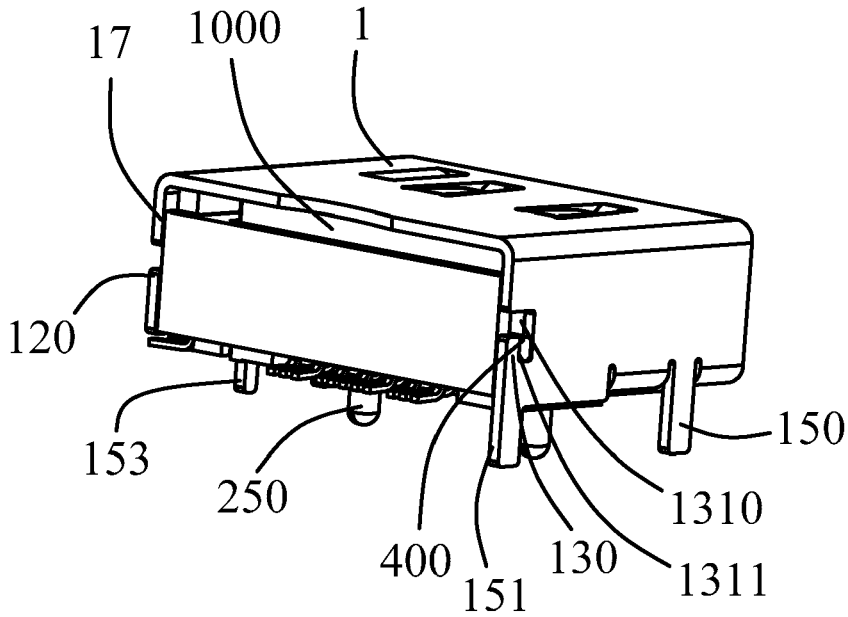
FIG. 21 is a perspective combination diagram illustrating an assembled electrical connector shown in FIG. 2 without associating with a circuit board in another view.

Please refer to FIG. 20 and FIG. 21. Furthermore, the insulating housing 2 with terminal sets 30, 32 and 31 and the terminal positioning plate 4 are accommodated in the first accommodating space 14 of the shield 1 to make the bottom plate 220 formed on the bottom 22 of the main body 20 of the insulating housing 2 located below and closely contact the lower side wall 11 of the shield 1. The side plate 210 formed on the left side 21 of the main body 20 of the insulating housing 2 is located at the right side of the left side wall 12 of the shield 1 and closely contact the left side wall 12 of the shield 1.

Finally, the terminal positioning plate 4 is pushed to make it engaging with the rear end 24 of the insulating housing 2 buckle with the shield 1. That comprises two steps: firstly, the terminal positioning plate 4 is pushed horizontally to respectively push the first positioning column 400 and the second positioning column 401 of the terminal positioning plate 4 into the first parts 1310 of the two identical grooves 120 and 130 of the shield 1; secondly, the terminal positioning plate 4 is pressed to respectively press the first positioning column 400 and the second positioning column 401 into the second parts 1311 of the grooves 120 and 130, and a gap 1000 is formed between the terminal positioning plate 4 and the shield 1. The first terminal set 30, the second terminal set 32 and the third terminal set 31 of the electrical conducting terminals 3 can be fixed in the insulating housing 2 through the terminal positioning plate 4, and further the insulating housing 2 can be fixed in the shield 1. After fixing the insulating housing 2 in the shield 1, the stop block 232 formed on the front end 23 of the main body 20 of the insulating housing 2 closely contacts the first stop portion 104 formed on the lower side wall 11 of the shield 1. When the mating connector inserted into the second accommodating space 161 (not shown) associates with the second tongue 231, the concave arc surface 2320 formed on the stop block 232 contacts the convex arc surface 1042 of the head portion 1041. The stop block 232 can press against the first stop portion 104 to prevent the first stop portion 104 from over deformation when the mating connector is inserted (not shown).

Because a machine is not required while fabricating the electrical conducting terminals 3 into the insulating housing 2 and further fabricating the insulating housing 2 into the shield 1, the terminal positioning plate 4 can directly fix the electrical conducting terminals 3 in the insulating housing 2 and further fix the insulating housing 2 in the shield 1. Therefore, manufacturing processes can be decreased and manufacturing cost can further be reduced.

Figure 22:
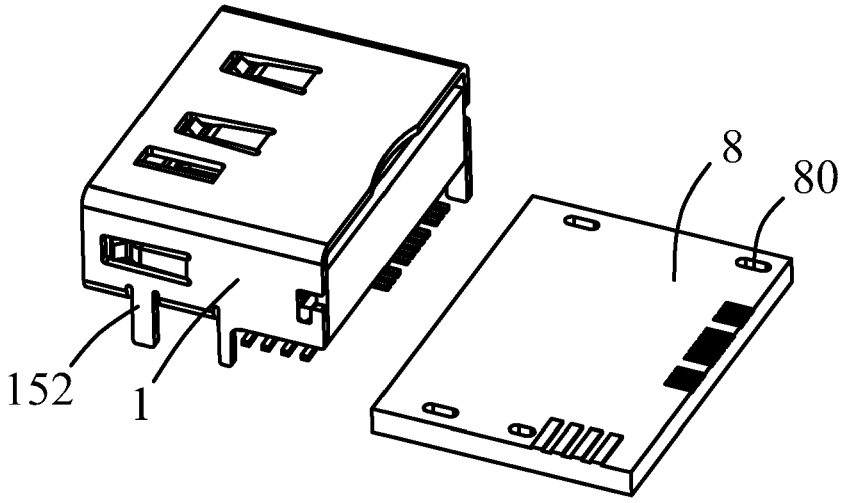
FIG. 22 is a perspective diagram illustrating a decomposition of an electrical connector and a circuit board of the assembled electrical connector shown in FIG. 2.

Please refer to FIG. 21 and FIG. 22. The four jointing feet 150, 151, 152 and 153 formed on the bottom 15 of shield 1 and the two positioning columns 250 formed on the bottom 25 of the insulating housing 2 are respectively fixed into the corresponding apertures 80 on the circuit board 8.

Figure 23:
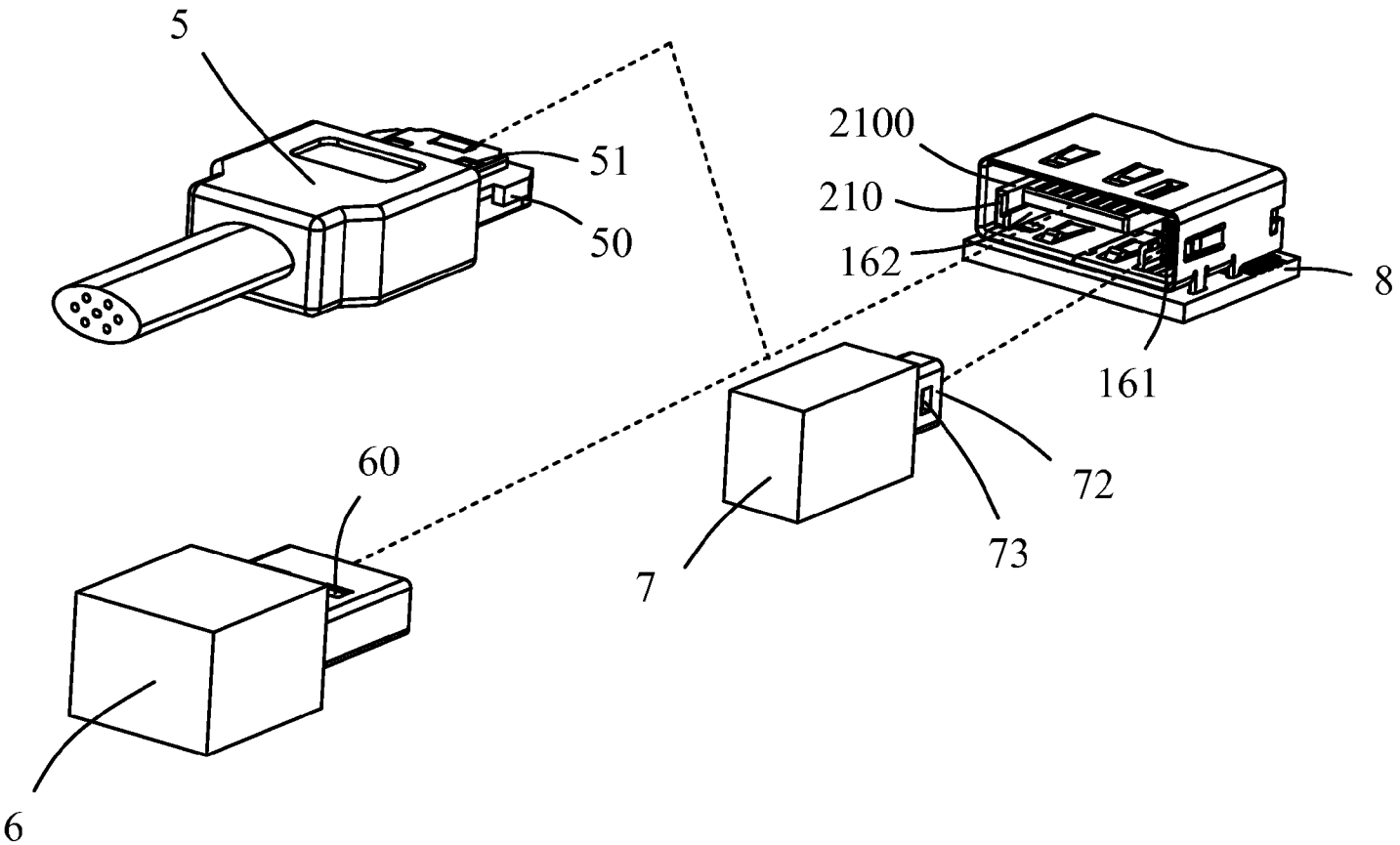
FIG. 23 is a perspective diagram illustrating an assembled electrical connector before associating with mating connectors respectively complied with E-SATA standard, USB standard and IEEE 1394B standard.
Figure 24:
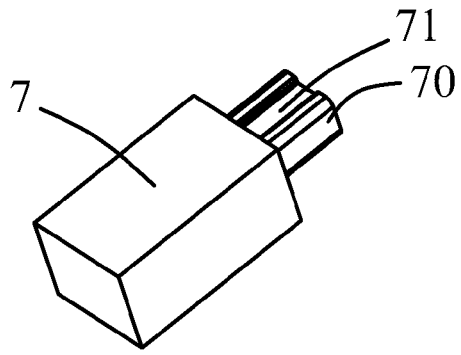
FIG. 24 is a perspective diagram illustrating a mating connector complied with IEEE 1394B standard for the assembled electrical connector of the invention.
Figure 25:
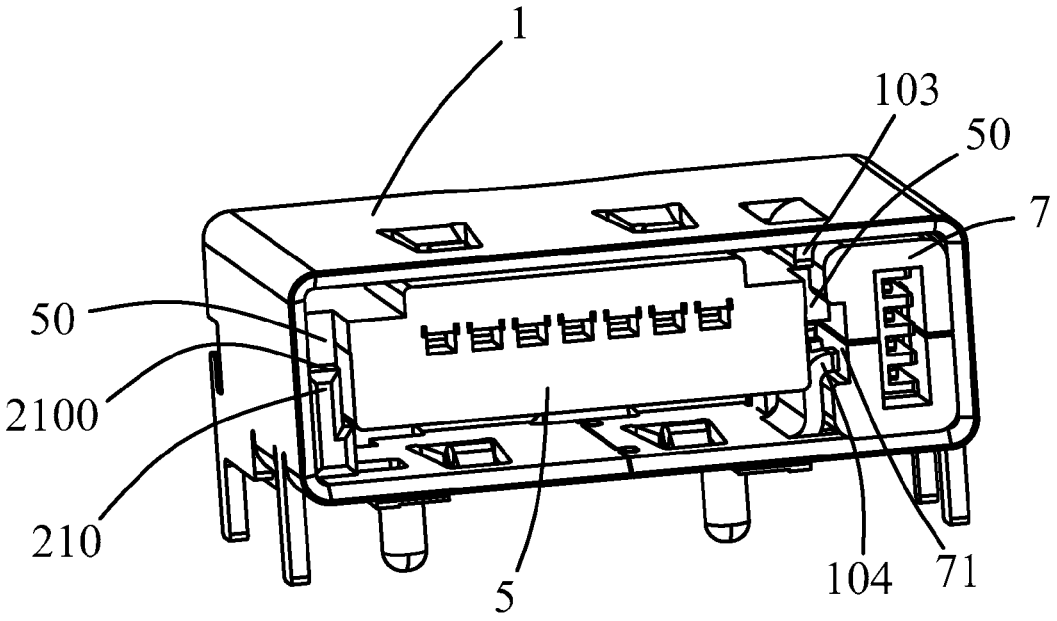
FIG. 25 is a perspectively cross-sectional diagram illustrating an assembled electrical connector after associating with mating connectors respectively complied with E-SATA standard and IEEE 1394B standard.
Figure 26:
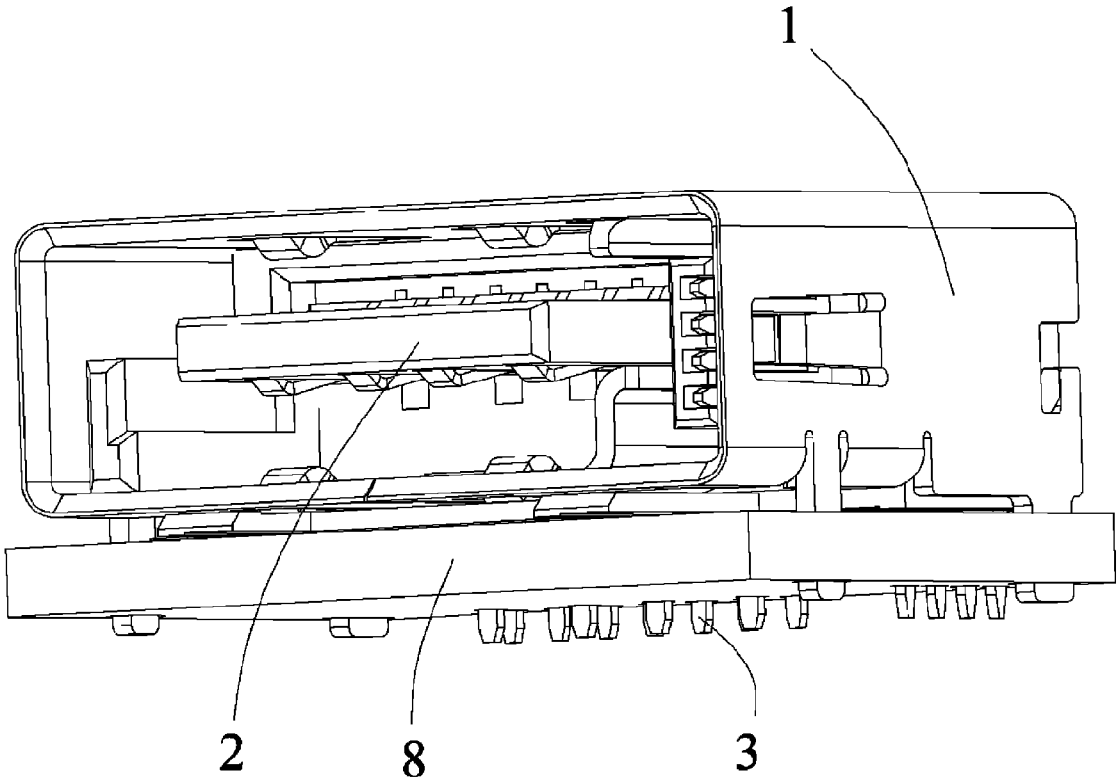
FIG. 26 is a perspective diagram illustrating an assembled electrical connector according to another embodiment of the invention.

Please refer to FIG. 23 to FIG. 25. A mating connector matched with the second tongue 231 is accommodated in the second accommodating space 161. The mating connector can be a mating connector 7 complied with IEEE 1394B standard matched with the third terminal set 31. A mating connector matched with the first tongue 230 is accommodated in the third accommodating space 162. The mating connector can be a mating connector 5 complied with E-SATA standard matched with the first terminal set 30, and it still can be a mating connector 6 complied with USB standard matched with the second terminal set 32. Two ends of the mating connector 5 respectively has a supporting block 50. A groove 71 is formed on a bottom surface 70 of the mating connector 7, and an aperture 73 is formed on a top surface 72.

When the mating connector 7 is associated with the second tongue 231, the groove 71 formed on the mating connector 7 is cooperated with the first stop portion 104. The first stop portion 104 can prevent the mating connector 7 from being reversely inserted into the third accommodating space 162; namely, it is a fool-proof function. Besides, the resilient tab 102 formed on the right side wall 13 of the shield 1 presses and contacts the top surface 72 of the mating connector 7, and the second stop portion 103 is located on a left side of the mating connector 7 for spacing the mating connector 7.

When the mating connector 5 is associated with the first tongue 230, the supporting block 50 formed on the mating connector 5 presses against the a top surface 2100 of the side plate 210 formed on the left side 21 of the main body 20 of the insulating housing 2 and a top surface 2321 (as shown in FIG. 20) of the stop block 232 formed on the front end 23 of the main body 20 of the insulating housing 2. Moreover, the resilient tabs 100 and the resilient tabs 101 respectively disposed on the upper side wall 10 and the lower side wall 11 of the shield 1 can respectively press and contact the mating connector 5 and the mating connector 6. Similarly, when the mating connector 6 is associated with the first tongue 230, the resilient tabs 100 and the resilient tabs 101 respectively disposed on the upper side wall 10 and the lower side wall 11 of the shield 1 can respectively press and contact the mating connector 6.

In the aforesaid electrical connector, the terminal feet of the electrical conducting terminals can be under surface mount technology (SMT) model; namely, the terminal feet is horizontal and be welded on the circuit board 8. Besides, the terminal feet still can be under dual in-line package (DIP) model; namely, the terminal feet is acicular and passes through the apertures (not shown) corresponding to the electrical conducting terminals 3 formed on the circuit board 8 and further be welded on the circuit board 8.

Compared with the prior art, the assembled electrical connector of the invention has a first tongue and a second tongue extended from the main body of the insulating housing 2 and perpendicular to the main body of the insulating housing 2, wherein the first tongue is longer than the second tongue, and the second tongue is located at a side of the first tongue in a lengthwise direction. Such a structure can miniaturize total volume of the electrical connector apparently and further miniaturize total volume of an electronic product utilizing the electrical connector. Except for this manner that the first tongue 230 is formed in horizontal and the second tongue 231 is formed in vertical, the first tongue 230 can be formed in vertical and the second tongue 231 can be formed in horizontal below the first tongue 230. Thus, the total volume of the assembled electrical connector also can be miniaturized in this manner. Besides, it also can form second tongues 231 in vertical respectively at both sides of the first tongue 230 formed in horizontal; therefore, the total volume of the assembled electrical connector can be miniaturized in this manner as well. Furthermore, because a machine is not required while fabricating the electrical conducting terminals 3 into the insulating housing 2 and further fabricating the insulating housing 2 into the shield 1, the terminal positioning plate 4 can directly fix the electrical conducting terminals 3 in the insulating housing 2 and further fix the insulating housing 2 in the shield 1. Accordingly, manufacturing processes can be decreased and manufacturing cost can further be reduced.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An assembled electrical connector, comprising:

an insulating housing having a main body;

a first tongue and a second tongue perpendicularly extending from the front end of the main body in the same direction, wherein the first tongue is wider than the second tongue, wherein the second tongue is arranged at a lateral side of the first tongue, adjacent to the first tongue, wherein the second tongue is perpendicular to the first tongue;

a shield for accommodating the first tongue and the second tongue, the shield comprising an upper, a lower, a left and a right side walls, wherein the shield comprises a second stop portion extending downward from the upper side wall, an accommodating space exists between the second stop portion, the upper side wall, the lower side wall and the right side wall; and at least two sets of electrical conducting terminals comprising a first terminal set and a second terminal set, wherein the first terminal set is arranged on a surface of the first tongue, and the second terminal set is arranged on a surface of the second tongue.

2. The assembled electrical connector of claim 1, further comprising a terminal positioning plate, each of two ends of the terminal positioning plate respectively has a positioning column, each of the left and right side walls of the shield respectively has a groove, and the positioning column is disposed in the groove.

3. The assembled electrical connector of claim 1, further comprising a terminal positioning plate, the terminal positioning plate further comprising a base and a protruding block formed on the base, a groove corresponding to the protruding block being formed on a rear end of the insulating housing, a first groove corresponding to the first terminal set is formed on a front surface of the base, a second groove corresponding to the second terminal set is formed on an external surface of the protruding block.

4. The assembled electrical connector of claim 1, wherein the first terminal set complies with E-SATA standard, the second terminal set complies with IEEE 1394B standard.

5. The assembled electrical connector of claim 1, wherein the shield further comprises a first stop portion, the first stop portion comprises a base portion extending upward from the lower side wall and a head portion extending from the base portion toward the second tongue.

6. The assembled electrical connector of claim 5, wherein a convex arc surface is formed on the head portion, the main body further comprises a stop block located between the first tongue and the second tongue, a concave arc surface is formed on a bottom of the stop block, and the concave arc surface closely contacts the convex arc surface.

7. The assembled electrical connector of claim 1, wherein the electrical conducting terminals further comprise a third terminal set disposed on a side of the first tongue in opposition to the first terminal set.

8. The assembled electrical connector of claim 7, wherein the third terminal set complies with USB standard.

9. An assembled electrical connector, comprising:

an insulating housing having a main body, a first tongue and a second tongue perpendicularly extending from the main body, wherein the first tongue is wider than the second tongue, wherein the second tongue is arranged at a lateral side of the first tongue;

at least two sets of electrical conducting terminals comprising a first terminal set and a second terminal set, wherein the first terminal set is arranged on a surface of the first tongue, and the second terminal set is arranged on a surface of the second tongue;

a shield accommodating the first tongue and the second tongue, the shield comprising an upper, a lower, a left and a right side walls; and a terminal positioning plate, each of two ends of the terminal positioning plate respectively has a positioning column, each of the left and right side walls of the shield respectively has a groove, and the positioning column is disposed in the groove.

10. The assembled electrical connector of claim 9, wherein the first terminal set complies with E-SATA standard, the second terminal set complies with IEEE 1394B standard.

11. The assembled electrical connector of claim 9, wherein the electrical conducting terminals further comprise a third terminal set disposed on a side of the first tongue in opposition to the first terminal set.

12. The assembled electrical connector of claim 11, wherein the third terminal set complies with USB standard.

13. An assembled electrical connector, comprising:

an insulating housing having a main body, a first tongue and a second tongue perpendicularly extending from the main body, wherein the first tongue is wider than the second tongue, wherein the second tongue is arranged at a lateral side of the first tongue;

at least two sets of electrical conducting terminals comprising a first terminal set and a second terminal set, wherein the first terminal set is arranged on a surface of the first tongue, and the second terminal set is arranged on a surface of the second tongue;

a terminal positioning plate, the terminal positioning plate further comprising a base and a protruding block formed on the base, a groove corresponding to the protruding block being formed on a rear end of the insulating housing, a first groove corresponding to the first terminal set is formed on a front surface of the base, a second groove corresponding to the second terminal set is formed on an external surface of the protruding block.

14. The assembled electrical connector of claim 13, wherein the first terminal set complies with E-SATA standard, the second terminal set complies with IEEE 1394B standard.

15. The assembled electrical connector of claim 13, wherein the electrical conducting terminals further comprise a third terminal set disposed on a side of the first tongue in opposition to the first terminal set.

16. The assembled electrical connector of claim 15, wherein the third terminal set complies with USB standard.

* * * * *